US008387817B1

(12) United States Patent
Zelechonok

(10) Patent No.: US 8,387,817 B1
(45) Date of Patent: Mar. 5, 2013

(54) CONTAINER FOR HOLDING MULTIPLE FLUIDS IN ISOLATION

(75) Inventor: Yury Zelechonok, Northbrook, IL (US)

(73) Assignee: SIELC Technologies Corporation, Prospect Heights, IL (US)

( * ) Notice: Subject to any disclaimer, the term of this patent is extended or adjusted under 35 U.S.C. 154(b) by 0 days.

(21) Appl. No.: 13/300,230

(22) Filed: Nov. 18, 2011

(51) Int. Cl.
*B65D 25/04* (2006.01)
*B65D 35/22* (2006.01)

(52) U.S. Cl. ... 220/530; 220/529; 220/535; 220/495.07; 220/495.09; 220/559; 137/259; 137/44

(58) Field of Classification Search ..... 220/530, 220/529; 222/386.5
See application file for complete search history.

(56) References Cited

U.S. PATENT DOCUMENTS

| | | | | | |
|---|---|---|---|---|---|
| 2,609,118 | A | * | 9/1952 | Cattaneo | 220/723 |
| 2,696,185 | A | * | 12/1954 | Snoddy | 114/74 R |
| 2,954,901 | A | | 10/1960 | Winstead | |
| 2,981,443 | A | | 4/1961 | Baldwin | |
| 3,042,271 | A | | 7/1962 | Winstead | |
| 3,090,526 | A | | 5/1963 | Hamilton et al. | |
| 3,112,047 | A | | 11/1963 | Weinreich et al. | |
| 3,687,050 | A | * | 8/1972 | Wilke | 396/630 |
| 3,943,873 | A | * | 3/1976 | Hering et al. | 114/125 |
| 4,452,473 | A | * | 6/1984 | Ruschke | 285/81 |
| 4,648,523 | A | * | 3/1987 | Strock | 220/530 |
| 4,791,013 | A | * | 12/1988 | Koboshi et al. | 428/35.3 |
| 5,163,485 | A | * | 11/1992 | Hermann | 141/10 |
| 5,199,594 | A | * | 4/1993 | Obara et al. | 229/117.3 |
| 5,526,957 | A | * | 6/1996 | Brown et al. | 222/94 |
| 6,227,441 | B1 | | 5/2001 | Sagel et al. | |
| 6,290,124 | B2 | | 9/2001 | Andrews, Sr. et al. | |
| 7,270,907 | B2 | * | 9/2007 | Becerra et al. | 429/447 |
| 7,681,783 | B2 | | 3/2010 | Stephenson | |
| 2001/0030228 | A1 | | 10/2001 | Todjar-Hengami | |

* cited by examiner

*Primary Examiner* — J. Gregory Pickett
*Assistant Examiner* — James M Van Buskirk
(74) *Attorney, Agent, or Firm* — John C. Shepard

(57) ABSTRACT

A container for holding fluids in isolation includes an outer container and two deformable inner containers carried within the internal space of the outer container. The outer container is provided with a view port enabling the user to visually examine the inner containers. The inner containers have respective ports communicating with their interiors. As fluid is withdrawn from the first inner container its volume is reduced so that the second container may receive a like amount of fluid. The second inner container may hold colorants or absorbents. The container may be used with various chemical applications, such as high performance liquid chromatography or fluid injection analysis, wherein supply fluid is withdrawn from the first inner container, used, and returned as waste fluid to the second inner container so that the overall volume of fluids remains relatively constant.

22 Claims, 4 Drawing Sheets

CONTAINER FOR HOLDING MULTIPLE FLUIDS IN ISOLATION

BACKGROUND OF THE INVENTION

1. Technical Field

The present invention pertains to a dispensing collection system that can be used to transport and store fluids and, more particularly, to a container for holding a plurality of fluids in isolation.

2. Background Art

Many processes employ liquids, solutions, solvents and other chemical fluids that need to be delivered and, after use, need to be discarded. Illustrative of one specific application that requires a source of supply liquid and produces waste liquid is liquid chromatography, such as high performance liquid chromatography (HPLC). Another application is fluid injection analysis (FIA) used in conducting continuous, high-throughput titrations, colorimetric analyses, enzymatic assays, and the like. Other applications that might require relatively large volumes of supply liquid and generate a similar volume of waste liquid are material scrubbing or washing applications, electroplating, and other similar processes.

HPLC technology is widely used to detect and identify different components contained in a test sample. Typical HPLC instruments use a high-pressure pump for forcing a suitable solvent, via capillary lines, at a controlled flow rate serially from a reservoir (usually a glass or plastic bottle), through a separation column and a UV or other type detector, and exhausting all fluids to a waste reservoir. The column contains an absorbent selected for components anticipated to be in the test samples. During a HPLC analysis run, a small quantity of the test sample injected into the flow of the pressurized solvent will travel into and through the separation column. The different subphase sample components pass through the column at different rates, each thereby becoming substantially isolated before passing the detector for individual identification.

Typical solvent (also called mobile phase) used in HPLC is a mixture of water with alcohols or acetonitrile (MeCN). Alternatively, the mobile phase can be a mixture of hexane with alcohols or other polar solvents. Different ionic modifiers (salts, acids, bases) also constitute mobile phase in small concentrations. This mobile phase is typically prepared by the HPLC instrument user prior to setting up for an HPLC analysis. Stages involved in mobile phase preparation include measuring of volume of all liquid ingredients, weighing all solid ingredients, dissolving and mixing of all components, adjusting pH if needed with acid or base monitoring by pH meter, filtering obtained solution, and removing dissolved gasses by inert gas purging or by vacuum. Typically, all of the steps are recorded in a laboratory notebook. After analysis is complete, the used mobile phase accumulated during the run is disposed of. All of these steps take time to complete and require an experienced technician to perform. Further, any errors in preparing for the run can be costly.

Similarly, chemical analysis using FIA includes a pump for effecting flow of a non-segmented, continuous carrier of suitable liquid from a supply reservoir through a tube. An injection port is provided along the tube for placing a measured amount of sample into the moving liquid stream. As the sample moves downstream through the tube and an optional reactor, radial and convection diffusion disperse and mix the sample with reagents or other components. Thereafter, the liquid zone containing the sample passes through a suitable detector and finally is deposited in a waste reservoir. Detectors often used in FIA include colorimeters, fluorometers, ion-selective electrodes, or biosensors that continuously detect changes in absorbance, electrode potential, or other measurable physical parameters.

If one is analyzing a high number of samples by these types of procedures, the amount of supply liquid required can be significant and preparation therefore requires either high volume or multiple repetitions. It is logical then for high volume analysis laboratories to contract out the preparation of such liquids. In addition, any waste liquid must be properly disposed of.

While the use of glass and plastic bottles in the prior art as a reservoir for unused and used liquids is sufficient for their intended function, other constructions may provide features that are more desirable and convenient for a user.

BRIEF SUMMARY OF THE INVENTION

The present invention is directed to overcoming one or more of the problems as set forth above.

It is an object of the present invention to provide a single container that can be used to deliver fluid supply and take away used or waste fluid.

In one aspect of the invention, a container for holding multiple fluids in isolation includes an outer container of predetermined volume and at least two variable-volume inner containers, one for supply fluid and one for waste fluid.

In another aspect of the invention, the inner container for supply fluid is deflatable and the inner container for waste fluid is expandable.

In a further aspect of the invention, the outer container defines a predetermined volume and the inner containers together define a second volume that is substantially the same as the first volume as fluid is simultaneously withdrawn from one inner container and returned to the other inner container.

In yet another aspect of the invention, each of the inner containers includes a port providing communication with the internal chamber defined by each container and each port is adapted to receive a flow line for moving fluid to or from the interior of the respective inner containers.

In a further aspect of the invention, a view port is provided in the outer container enabling a user to visually ascertain the fluid levels in at least one of the inner containers.

In another aspect of the invention, a colorant is provided in one container enabling a user to more clearly see fluid levels in the container as it is being filled and the other emptied.

In another aspect of the invention, an absorbent is provided in one container to create a solid or semi-solid to minimize possible fluid leakage and to enable the container to be more securely transported and disposed of.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

Figure 1:
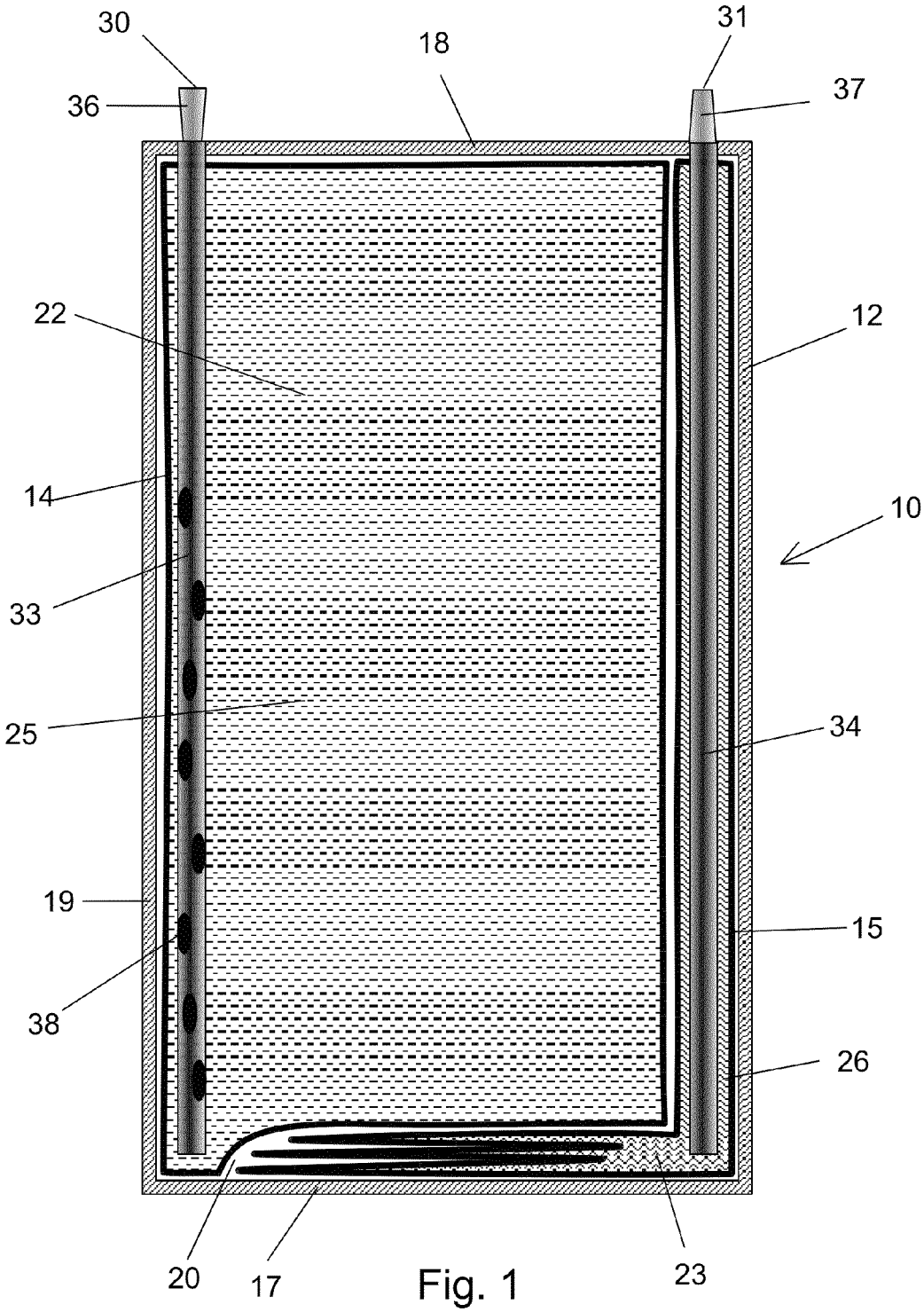
FIG. 1 is a vertical cross-sectional view of a container embodying the principles of the invention showing a fluid supply container and a near-empty fluid waste container.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated. To illustrate the function of the invention, its application within an HPLC system is described, but it should be fully understood that the present invention is not limited to HPLC use only.

Referring to the drawings in greater detail, and more particularly to FIG. 1, a transportable container, generally designated 10, is seen to include an outer container 12 and a pair of inner containers 14 and 15, respectively. The outer container 12 functions as a holder, while the inner containers 14 and 15 function as variable-volume, fluid-holding cells. Herein, the inner containers 14 and 15 are flexible sealed bags that divide the outer container 12 into separate, isolated compartments. As shown herein, the bags 14 and 15 are generally positioned one on top of the other.

The outer container 12 is defined by a bottom wall 17, a top wall 18 spaced above the bottom wall 17 and a wrapping side wall 19 extending therebetween. The top edge of the side wall 19 connects to the top wall 18 and the bottom edge of the side wall 19 connects with the bottom wall 17 to define an internal space 20 with a predetermined volume. The outer container 12 is preferably made from rigid material, such as cardboard, plastic or other suitable material. The outer container 12 may also be made of somewhat flexible material so long as it is capable of carrying the inner containers and functions suitably for the purposes proposed herein. When used with HPLC systems, the internal volume is defined to be sufficient for one day of operation of typical HPLC analysis. With a most common flow rate in HPLC 1 milliliter per minute, the overall volume of fluid should be about 1 liter which enough for 16 hours of operation.

The inner containers 14 and 15 are disposed within the volume of the outer container 12, are deformable, and are impermeable to the fluids that they are to hold. The first inner container 14 is collapsible and defines an internal chamber 22 having a variable volume. The second inner container is expandable and defines an internal chamber 23 having a variable volume.

Each of the inner containers 14 and 15 when fully expanded is capable of substantially occupying the entire internal volume of the outer container 12 not occupied by the other inner container. While the inner containers 14 and 15 may take many forms, they are shown herein as plastic bags folded in accordion fashion. They may also be flaccid, crushable bags or take on any other suitable form. The bags are preferably made with non-opaque material, i.e., clear or translucent, so that the fluids and their respective volumes within the containers 14 and 15 may be viewed by the user. The inner containers 14 and 15 may be sealed within the outer container 12, or removable from the outer container 12, or otherwise carried by the outer container 12.

The first inner container 14 has an outlet port, generally designated 30, communicating with the internal chamber that is adapted to receive a flow line (not shown) to withdraw fluid from the chamber. The second inner container has an inlet port, generally designated 31, communicating with the internal chamber that is adapted to receive a flow line (not shown) to deliver fluid to the chamber.

The ports 30 and 31 respectively include straw-like, elongate, hollow tubes 33 and 34 that have upper free ends exposed above the top of the outer container 12. The tubes 33 and 34 extend downwardly terminating internally at lower ends near the bottom of the chambers 22 and 23 of the inner containers 14 and 15. The exposed ends of the tubes 33 and 34 include releasable, low-pressure connectors, such as luer-type connectors 36 and 37, respectively, enabling a user to selectively connect flow lines thereto. The connectors are appropriately configured as different types, such as female connector 36 and male connector 37, so there is only one way to properly connect the containers to a HPLC system. The supply tube 33 may be rigid or flexible and include perforations or openings, collectively designated 38, in its side wall along the length thereof to prevent the tube 33 from being plugged while fluid is suctioned from the inner supply container 14 through its internal passageway. The discharge tube 35 is preferably rigid so that the tube opening at the lower end of its internal passageway will remain near the bottom of the inner waste container 15.

The outer and inner containers are configured so that the volume of the outer container 12 will be substantially equal to the overall fluid volume held by the inner containers 14 and 15. As seen in the drawings, when fluid is withdrawn from filled container 14, it gradually deflates (FIG. 2) to a collapsed condition (FIG. 3) enabling the empty container 15 to inflate. Similarly, as a similar amount of fluid is delivered to the empty container 15, it gradually inflates (FIG. 2) to an expanded condition (FIG. 3) filling the space no longer occupied by container 14. In a HPLC system, fluid going into the system is substantially the same as the waste fluid exiting the system. Thus, mobile phase can be delivered from and withdrawn using a single transportable outer container.

It is also contemplated that if more than one solvent is required for a specific analysis, the outer container may have two or more inner containers filled with different unused mobile phase and one or more additional empty inner containers for receiving and isolating different types of waste.

Figure 4:
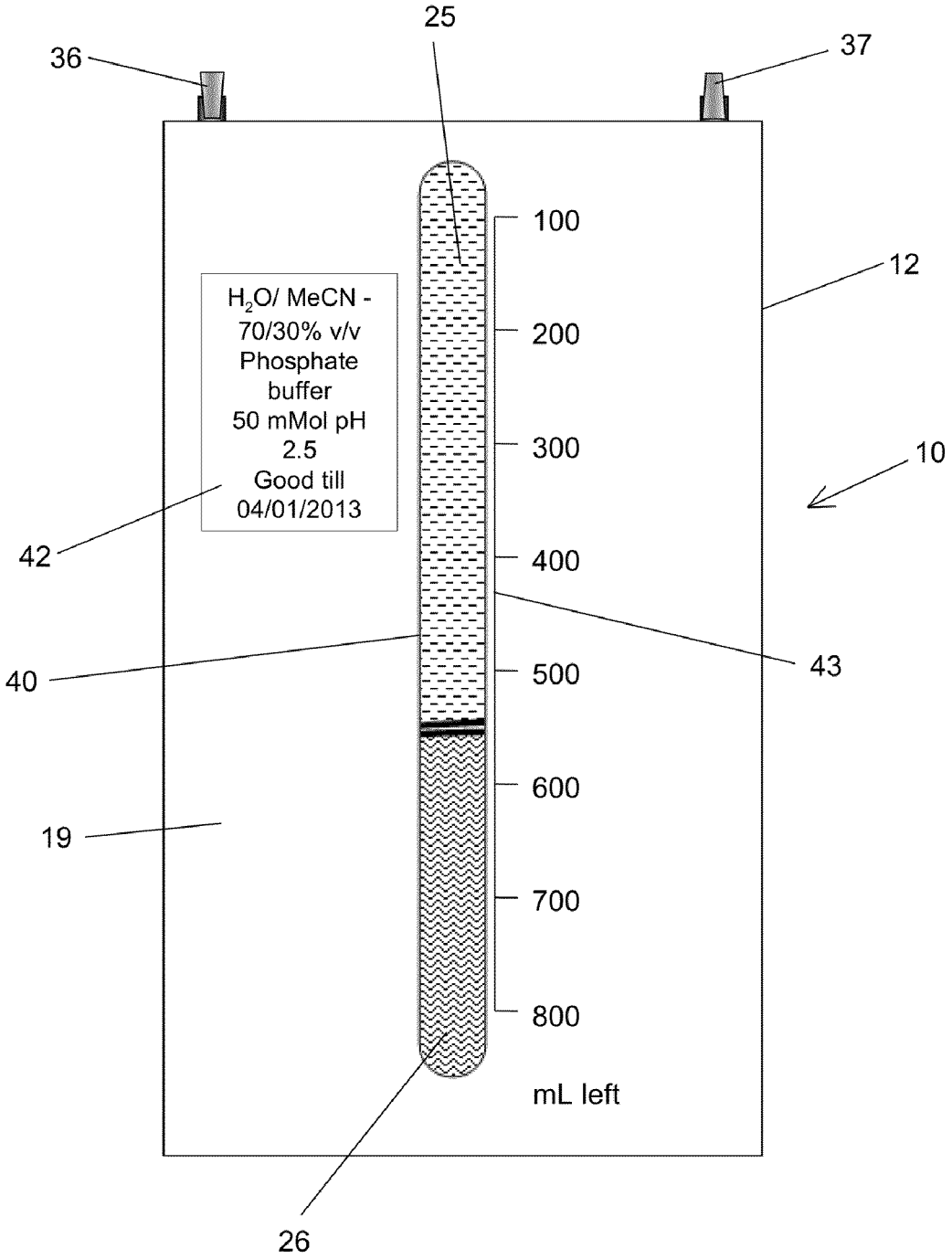

To allow the inner containers 14 and 15 to be seen, a view port 40 is formed in the side wall 19 of the outer container 12. This may be a cutout as shown in FIG. 4 or it may be a portion of the side wall that is formed with clear material. In this manner, a user is permitted to visually determine the fluid volume in each of the containers.

A colorant or dye may be added to the waste container 15 so that as fluid is introduced therein, the visibility of the fluid in increased and may be perceived more easily by a user.

It should be understood that disposal of chemical waste is a continuing problem. In addition, the disposal of liquid waste is more complex and needs to be carried out differently than the disposal of solids. To lessen liquid disposal issues of the waste receiving container 15, a small amount of superabsorbent can be placed in the waste container 15. A superabsorbent is capable of holding many times more liquid then its own weight. The superabsorbent transforms waste fluid into a solid, semi-solid or gel form. After mobile phase is consumed and directed into the inner container 15, the waste is solidified by the superabsorbent and the container 12 can thereafter be disposed as solid waste.

Superabsorbents used with alcohols are discussed in an article entitled "Super Alcohol-Absorbent Gels of Sulfonic Acid-Contained Poly(acrylic acid)" by Kourosh Kabiri, et al., published in the Journal of Polymer Research, Volume 19, Number 3, pp. 449-58 (2010). One commercial superabsorbent that may be used to produce hydroalcoholic gels in an HPLC application is a commercial product known as Carbopol® made by Lubrizol of Wickliffe, Ohio.

As best seen in FIG. 4, indicia 42 or information printed or otherwise is placed on the side wall 19 of the outer container 12. This user viewable indicia 42 denotes identifying parameters relating to the container including the name of the fluid, its composition, its manufacturer, lot number, expiration date, disposal instructions, the name of the user, etc. Scannable bar codes can be preprinted on the external surface of the outer container enabling automated scanning of information. When placed adjacent to the view port 40, a scale 43 or measure markings indicating the volume or ratio of new fluid and used fluid can be easily ascertained by a user.

While the container 10 described herein is intended to deliver fresh mobile phase and remove used-up (waste) mobile phase in the HPLC field, this container design can also be used in other fields of chemical analysis where liquid is used as a transport means. One such example would be use in flow injection analysis (FIA) described above.

Figure 2:
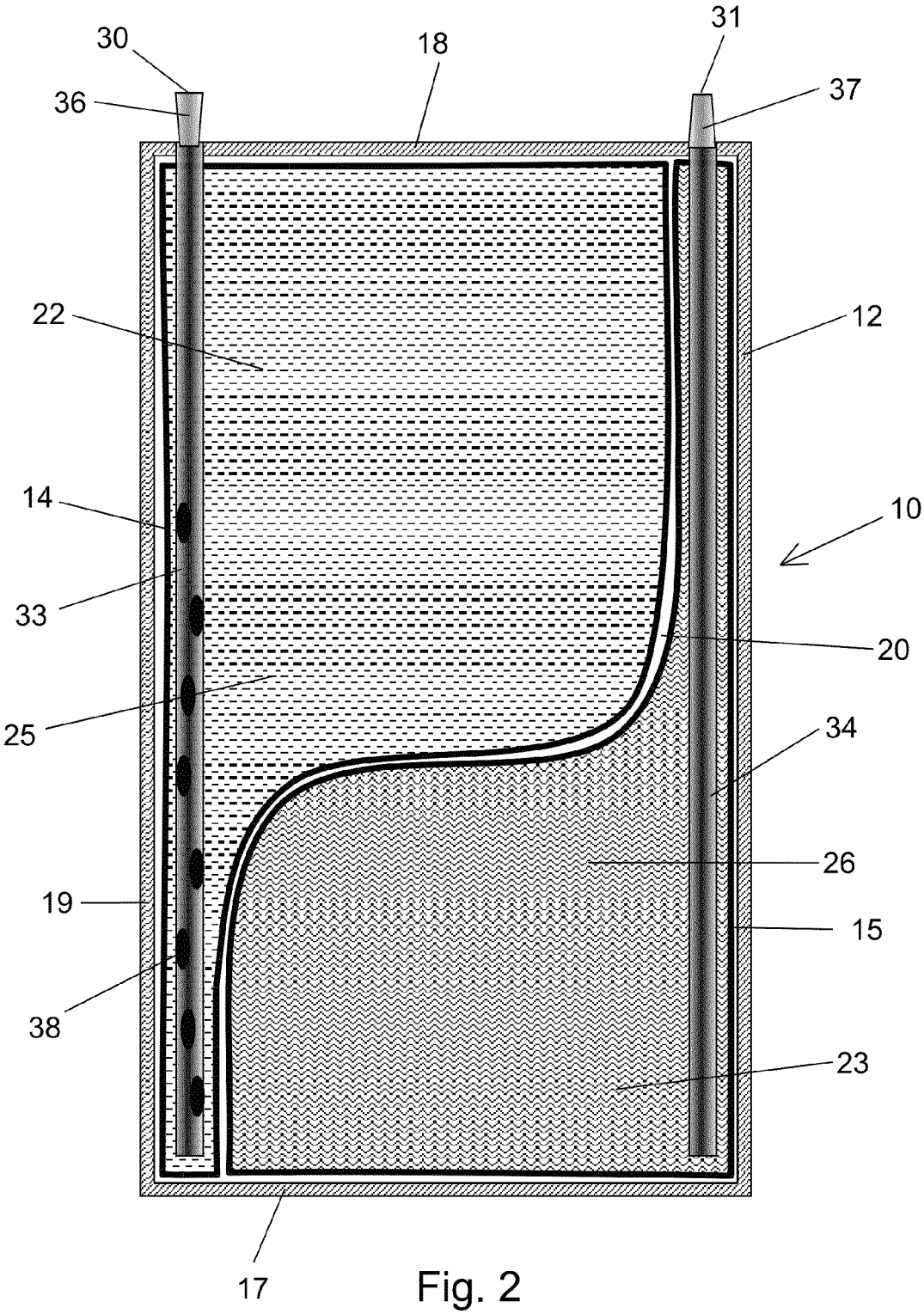
FIG. 2 is a vertical cross-sectional view of a container similar to FIG. 1 showing a partially-full fluid supply container and a partially-full fluid waste container.
Figure 3:
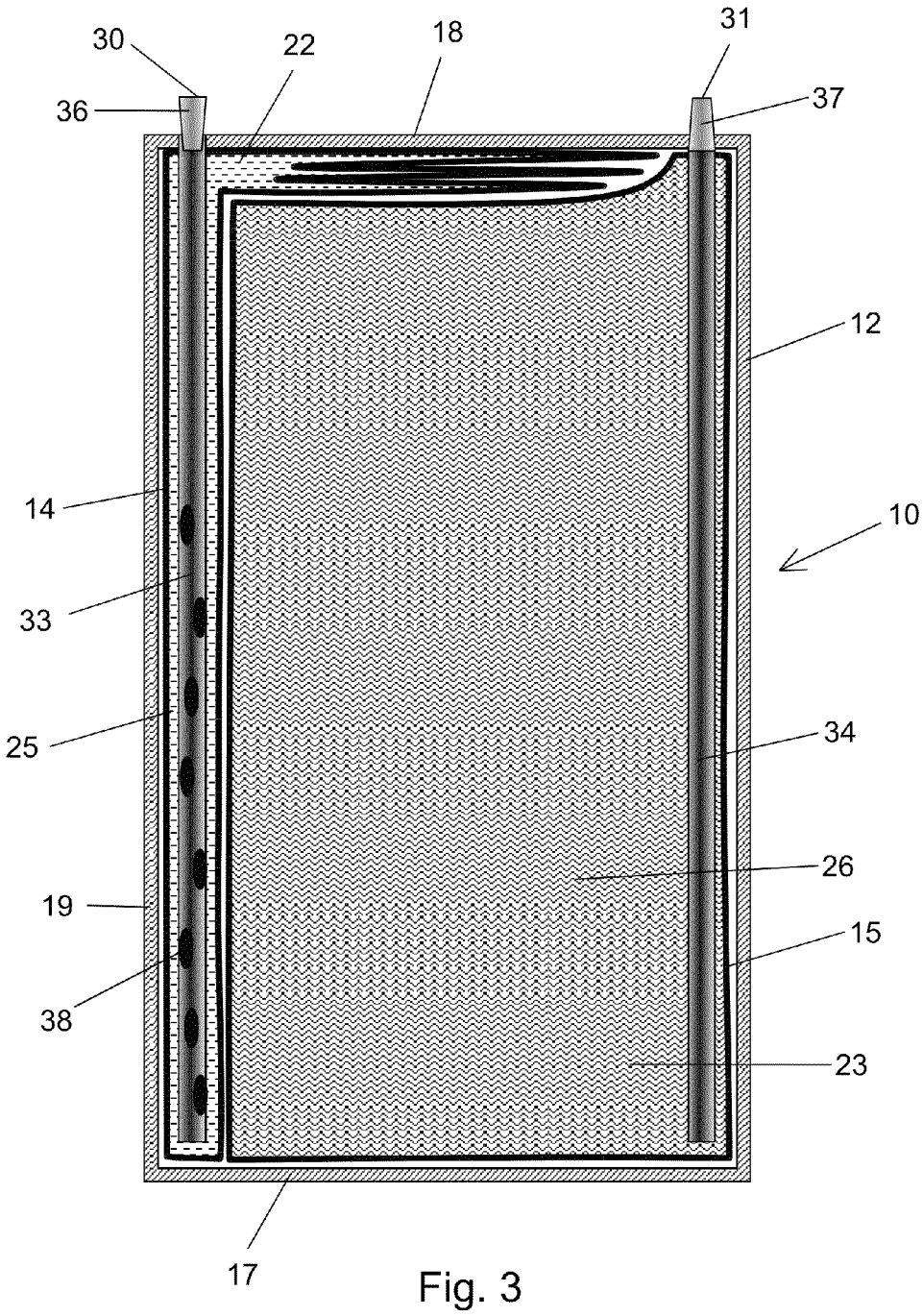
FIG. 3 is a vertical cross-sectional view of a container similar to FIG. 1 showing a near-empty fluid supply container and a full fluid waste container; and, FIG. 4 is a front elevational view of the container in FIG. 1 showing a scaled view port and visual indicia.

When the container 12 is delivered to a customer or user, the container 12 will be filled with premixed mobile phase which substantially occupies the entire container's volume as seen in FIG. 1. When this container attached to HPLC instrument, the mobile phase is suctioned from the bag 14 by the HPLC instrument pump. The used up mobile phase (waste) after analysis is returned to the same container 12 into the empty bag 15 as seen in FIG. 2. In this manner, the outer container 12 holds both fresh mobile phase and waste mobile phase. When the mobile phase is completely consumed, substantially the entire volume of the outer container 12 is taken up by the waste fluid as seen in FIG. 3. At this point, the container 12 can be disconnected from the instrument and disposed of or sent for recycling.

It is understood that the containers may comprise any hollow container, including but not limited to bags, jars, bottles, boxes, or the like, as long as they are expandable, i.e., they may be inflated or deflated to change their internal volume. For example, an inner bag may be suitable if it is thin-walled, flaccid, or crushable; a bottle may be suitable if made of plastic with an accordion-style side wall; or, a box may be suitable it is foldable or collapsible. It is also understood that where low pressures are involved, the container material and construction should be selected such that the inner containers yield to pressure readily and without resistance so that they are easily inflated and deflated. It also understood that the inner containers have variable volumes and that the collapsible container may be expandable and that the expandable container may be collapsible.

INDUSTRIAL APPLICABILITY

It should be apparent the container described herein is a simple, functional unit that is effective and easily manufactured.

Other aspects, objects and advantages of this invention can be obtained from a study of the drawings, the disclosure, and the appended claims.

It should be understood that the terms "top," "bottom," "upper," "lower," "front," "back," "side," "end," "first," "second," and similar terms as used herein, have reference only to the structure shown in the drawings and are utilized only to facilitate describing the invention. The terms and expressions employed herein have been used as terms of description and not of limitation.

From the foregoing, it will be observed that numerous variations and modifications may be effected without departing from the spirit and scope of the invention. It will also be observed that the various elements of the invention may be in any number of combinations, and that all of the combinations are not enumerated here. It will be understood that no limitation with respect to the specific apparatus illustrated herein is intended or should be inferred. While specific embodiments of the invention have been disclosed, one of ordinary skill in the art will recognize that one can modify the materials, dimensions and particulars of the embodiments without straying from the inventive concept.

What is claimed is:

1. A container for holding fluids in isolation, the container comprising:

an outer container having a side wall with a bottom, said outer container defining an internal space with a predetermined volume;

first and second inner containers disposed within said outer container volume adapted and configured to carry said inner containers, said inner containers being separate from one another;

said first inner container being collapsible and having a bottom at least partially disposed adjacent the bottom of said outer container and defining a fluid-holding internal chamber having a variable volume;

an outlet port providing communication with the internal chamber of said collapsible first inner container including a first elongate hollow tube having a side wall defining an internal passageway for carrying fluid between a lower end terminating at a position adjacent the first inner container bottom and an upper exposed free end adapted to receive a flow line for withdrawing fluid therefrom;

said second inner container being expandable and having a bottom at least partially disposed adjacent the bottom of said outer container and defining a fluid-holding internal chamber having a variable volume;

an inlet port providing communication with the internal chamber of said expandable second inner container including a second elongate hollow tube having a side wall defining an internal passageway for carrying fluid between an upper exposed free end adapted to receive a flow line and a lower end terminating at a position adjacent the second inner container bottom for delivering fluid thereto; and, said inner containers occupying not more than said predetermined volume of said outer container, whereby in use said collapsible first inner container is initially expanded and holds fluid and said expandable second inner container is initially collapsed and empty, and whereby fluid withdrawn from said collapsible first inner container effects its deflation and fluid delivered to said expandable second inner container effects its inflation so that the overall volume of said inner containers may remain substantially constant.

2. The container of claim 1 wherein said outer container is a relatively rigid box and said collapsible and expandable containers are flaccid bags.

3. The container of claim 2 wherein said outer container is made of cardboard.

4. The container of claim 2 wherein said collapsible and expandable containers are made of plastic.

5. The container of claim 1 wherein said collapsible container tube side wall includes at least one opening extending through the side wall to said passageway.

6. The container of claim 1 wherein said outer container has a top wall connecting with the top edge of said side wall, said collapsible and expandable containers positioned at least partially under the top wall, and said elongate tubes extend from the outer container internal space through the top wall thereby enabling a user to selectively connect flow lines to the exposed free ends of said tubes.

7. The container of claim 1 wherein the respective free ends of said tubes include a releasable connector.

8. The container of claim 7 wherein said releasable connectors are luer-type connectors.

9. The container of claim 1 wherein said outer container defines a view port permitting a user to visually determine the fluid volume in an inner container.

10. The container of claim 9 wherein said inner containers are non-opaque.

11. The container of claim 10 wherein said expandable container contains a colorant to increase the visibility of any fluid present therewithin.

12. The container of claim 1 wherein said outer container has indicia on said side wall viewable by a user denoting identifying parameters relating to contents of said outer container.

13. The container of claim 1 wherein said expandable container holds an absorbent material.

14. A container for holding fluids in isolation, the container comprising:

a transportable container having a side wall with a bottom, said transportable container defining an internal space with a predetermined volume;

first and second cells disposed within said container space adapted and configured to carry said cells, said cells being separate from one another;

said first cell being collapsible and having a bottom at least partially disposed adjacent the bottom of said transportable container and defining a fluid-holding internal chamber having a variable volume;

an outlet port providing communication with the internal chamber of said collapsible first cell and including a first elongate hollow tube having a side wall defining an internal passageway for carrying fluid between a lower end terminating at a position adjacent the first cell bottom and an upper exposed free end adapted to receive a flow line for withdrawing fluid therefrom;

said second cell being expandable and having a bottom at least partially disposed adjacent the bottom of said transportable container and defining a fluid-holding internal chamber having a variable volume;

an inlet port providing communication with the internal chamber of said expandable second cell and including a second elongate hollow tube having a side wall defining an internal passageway for carrying fluid between an upper exposed free end adapted to receive a flow line and a lower end terminating at a position adjacent the second cell bottom for delivering fluid thereto; and, said cells occupying not more than said predetermined volume of said transportable container, whereby in use said collapsible first cell is initially expanded and holds fluid and said expandable second cell is initially collapsed and empty, and whereby fluid withdrawn from said collapsible first cell effects its deflation and fluid delivered to said expandable second cell effects its inflation so that the overall volume of said cells may remain substantially constant.

15. The container of claim 14 wherein said transportable container is a relatively rigid box and said cells are flaccid bags.

16. The container of claim 14 wherein the respective free ends of said tubes include a releasable connector.

17. The container of claim 14 wherein said transportable container defines a view port permitting a user to visually determine the fluid volume in a cell.

18. The container of claim 14 wherein said cells are non-opaque so that fluid within the internal chamber of said cells is visible through said transportable container view port and said expandable cell contains a colorant to increase the visibility of any fluid present within said expandable cell.

19. The container of claim 14 wherein said transportable container has indicia on said side wall viewable by a user denoting identifying parameters relating to contents of said transportable container.

20. The container of claim 14 wherein said expandable cell holds an absorbent material.

21. A container for holding fluids in isolation, the container comprising:

an outer container having a side wall with a bottom, said outer container defining an internal space with a predetermined volume;

first and second inner containers disposed within said outer container volume adapted and configured to carry said inner containers, said inner containers being separate from one another;

said first inner container being collapsible and having a bottom and defining a fluid-holding internal chamber having a variable volume;

an outlet port providing communication with the internal chamber of said first inner container and including a first elongate hollow tube having a side wall defining an internal passageway for carrying fluid between a lower end within said first inner container and an upper exposed free end adapted to receive a flow line to withdraw fluid said first inner container;

said second inner container being expandable and having a bottom and defining a fluid-holding internal chamber having a variable volume;

an inlet port providing communication with the internal chamber of said second inner container and including a second elongate hollow tube having a side wall defining an internal passageway for carrying fluid between an upper exposed free end adapted to receive a flow line and a lower end within said second inner container to deliver fluid to said second inner container;

said outer container defining a view port permitting a user to visually determine the fluid volume in an inner container, at least one of said inner containers being non-opaque, said non-opaque inner container holding a colorant to increase the visibility of any fluid present therewithin; and, said inner containers occupying not more than said predetermined volume of said outer container, whereby in use said collapsible first inner container is initially expanded and holds fluid and said expandable second inner container is initially collapsed and empty, and whereby fluid withdrawn from said collapsible first inner container effects its deflation and fluid delivered to said expandable second inner container effects its inflation so that the overall volume of said inner containers may remain substantially constant.

22. The container of claim 21 wherein said expandable second inner container holds a superabsorbent material.

* * * * *